US008739500B2

(12) United States Patent
Yu Chen

(10) Patent No.: US 8,739,500 B2
(45) Date of Patent: Jun. 3, 2014

(54) BAG NECK SEALER

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 0 days.

(21) Appl. No.: 13/770,037

(22) Filed: Feb. 19, 2013

(65) Prior Publication Data

US 2013/0160401 A1 Jun. 27, 2013

Related U.S. Application Data

(63) Continuation-in-part of application No. 12/859,146, filed on Aug. 18, 2010, now abandoned.

(51) Int. Cl.
*B65B 51/08* (2006.01)

(52) U.S. Cl.
USPC ..... 53/139.1; 53/583; 53/285; 30/289; 30/278

(58) Field of Classification Search
CPC .... B65B 67/06; B65B 51/065; B65B 57/005; B65B 61/005; B65B 7/02; B26B 29/02
USPC ..... 53/139.1, 583, 137.2, 138.1, 138.3, 53/138.6–138.8, 139.4; 225/19–20; 83/860; 30/282, 286, 289
See application file for complete search history.

(56) References Cited

U.S. PATENT DOCUMENTS

| | | | | | |
|---|---|---|---|---|---|
| 365,714 | A | * | 6/1887 | Warner | 30/286 |
| 2,194,707 | A | * | 3/1940 | Locker | 30/2 |
| 2,663,369 | A | * | 12/1953 | Erhardt | 225/20 |
| 2,730,800 | A | * | 1/1956 | Bailey | 30/2 |
| 4,579,267 | A | * | 4/1986 | Planke | 225/54 |
| 4,718,220 | A | * | 1/1988 | Van Rosendal et al. | 53/583 |
| 5,097,733 | A | * | 3/1992 | Benkoski | 83/440.2 |
| 5,241,750 | A | * | 9/1993 | Chomiak | 30/2 |
| 5,600,934 | A | * | 2/1997 | van Rosendal et al. | 53/139.1 |
| 5,843,107 | A | * | 12/1998 | Landis et al. | 606/167 |
| 6,314,647 | B1 | * | 11/2001 | Coxsey | 30/188 |

* cited by examiner

*Primary Examiner* — Andrew M Tecco
(74) *Attorney, Agent, or Firm* — Ming Chow; Sinorica, LLC

(57) ABSTRACT

A bag neck sealer includes a base. The base includes an installation wheel, a rotary wheel, a press plate, a movable blade unit and a fixed blade unit. The fixed blade unit has a seat. The seat includes a fixed blade and a protective piece thereon. The protective piece is connected with an elastic member to be against one side of the fixed blade opposite to the seat to shield the edge of the fixed blade. Therefore, when the user operates the bag neck sealer, the user's fingers can be protected from the fixed blade through the protective piece, preventing the fingers from being hurt so as to enhance the safety of the bag neck sealer.

7 Claims, 11 Drawing Sheets

BAG NECK SEALER

This application is a Continuation in-part of U.S. patent application Ser. No. 12/859,146 filed on Aug. 18, 2010.

BACKGROUND OF THE INVENTION

1. Field of the Invention

The present invention relates to a bag neck sealer.

2. Description of the Prior Art

A plastic bag is commonly used to carry articles contained therein. In order to prevent the articles contained to fall out, a bag neck sealer is usually to be used to seal the open end and cut away the protruded portion of the bag. Referring to FIG. 1, a conventional bag neck sealer comprises a base 1 which has a guide trough 2 provided on the top portion thereof. An installation wheel 3 is contained in the base 1. A rotary wheel 4, a press plate 5, a movable blade unit 6 and a fixed blade unit 7 are provided close to the guide trough 2. When the bag neck sealer is used, the user has to install a roll of adhesive tape 8 on the installation wheel 3 and pull out the tape to be adhered on the press plate 5. After that, the open end of the bag will be tape sealed with the cooperation of the rotary wheel 4 and the press plate 5. The open end portion of the bag will be moved along the guide trough 2. Finally, the movable blade unit 6 will cut off the tape and the fixed blade unit 7 will cut away the unnecessary portion of the bag to complete the seal of the bag. However, the fixed blade unit 7 of the conventional bag neck sealer is disposed at an outer side of the base 1 without a protection device. When operate the bag neck sealer, the fingers of the user may be hurt. Accordingly, the inventor of the present invention has devoted himself, based on his many years of practical experiences, to solve this problem.

SUMMARY OF THE INVENTION

It is therefore the principle object of the present invention to provide a bag neck sealer having a safety lid to protect the user's finger not to be injured during the bag seal operation using the sealer.

Another object and an important feature of the present invention is to proved a new mechanism in the moving blade and fixed blade to form a smooth operation of the seal and cut operation of the bag neck sealer according to the present invention.

Therefore in summary, the bag neck sealer according to the present invention comprises a base with a guide trough formed thereon and an installation wheel installed thereon. A rotary wheel, a press plate and a movable blade unit are provided close to the guide trough. A fixed blade unit is provided on one side of the base and also located close to the guide trough. The fixed blade unit has a seat which has a cutting slot corresponding to the guide trough of the base. The seat comprises a fixed blade installed therein. The fixed blade has an edge across the cutting slot. The seat further comprises a protective piece. A protective piece, which is biased by an elastic member, is connected to be against to one side of the fixed blade opposite to the seat to shield the edge of the fixed blade. Therefore, when the user operates the bag neck sealer, the user's fingers can be protected from the fixed blade through the protective piece, preventing the fingers from being injured.

BRIEF DESCRIPTION OF THE DRAWINGS

The detailed description of the preferred embodiment of the bag neck sealer according to the present invention can be more readily understood by the below description with reference to the accompanying drawings, wherein.

DETAILED DESCRIPTION OF THE PREFERRED EMBODIMENTS

Figure 1:
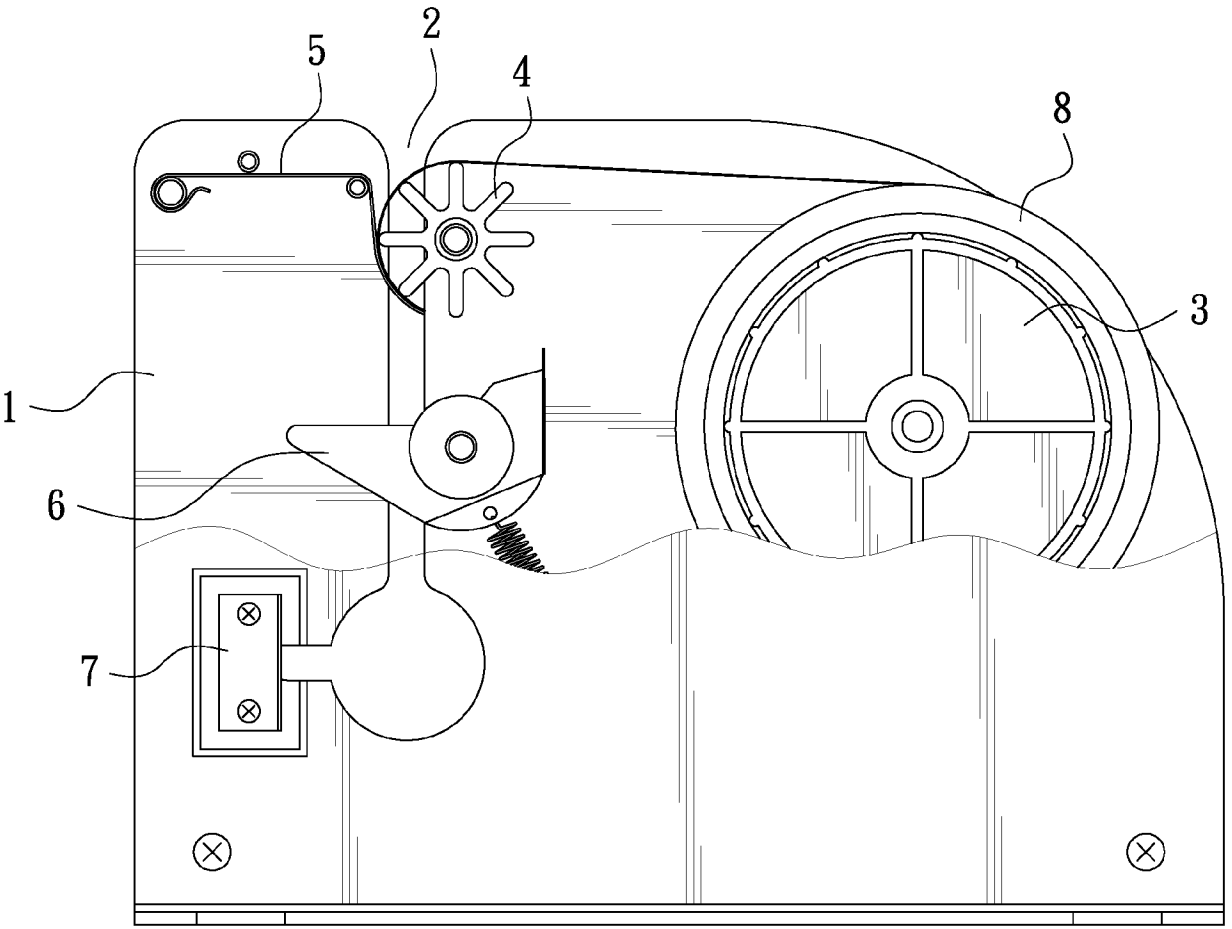
FIG. 1 PRIOR ART
FIG. 1 is an illustrative front view of a conventional bag neck sealer.
Figure 2:
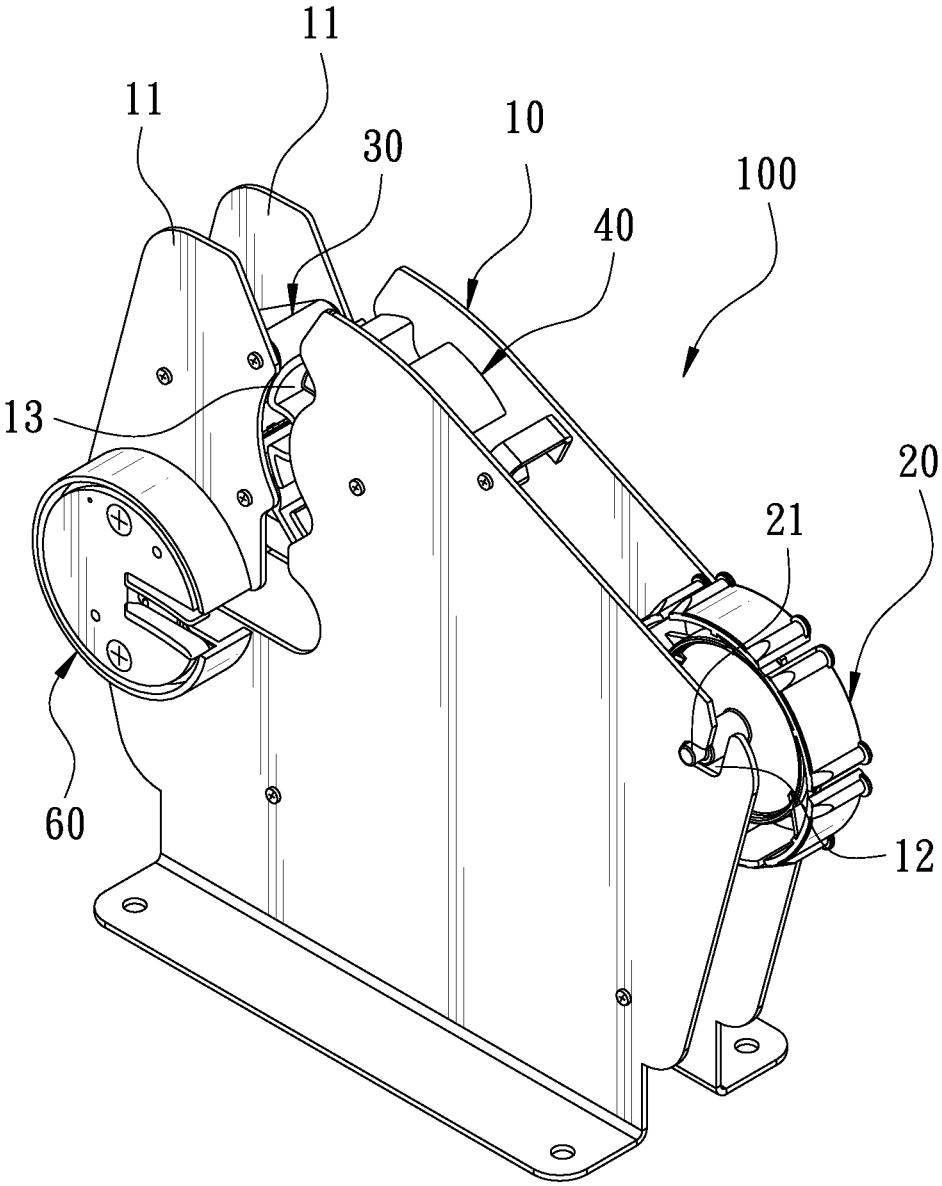
FIG. 2 is a perspective view according to a preferred embodiment of the present invention.
Figure 3:
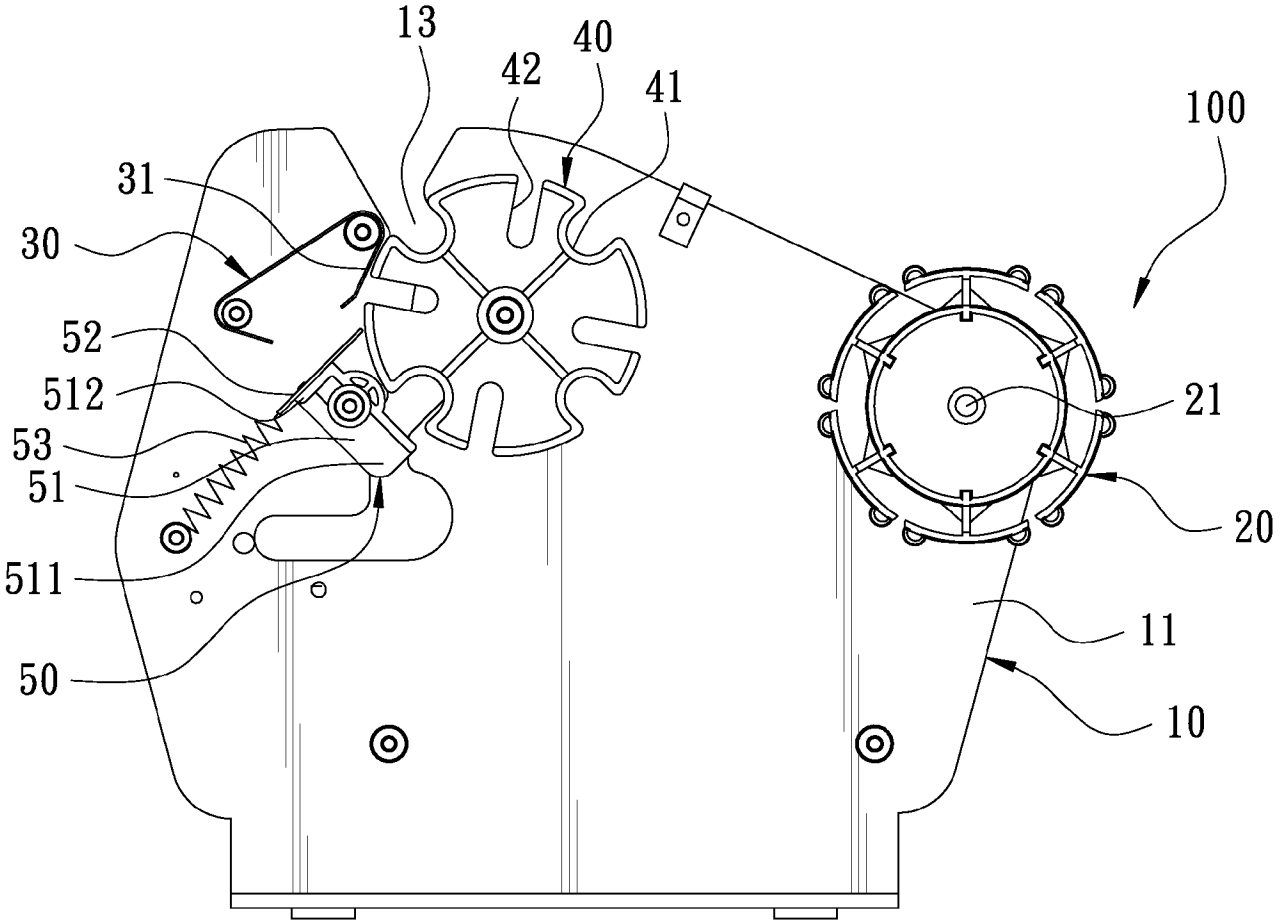
FIG. 3 is a cross-sectional view according to the preferred embodiment of the present invention.

As shown in FIG. 2 and FIG. 3 which show the perspective and sectional views of a bag neck sealer 100 according to a preferred embodiment of the present invention, the bag neck sealer comprises a base 10, an installation wheel 20, a press plate 30, a rotary wheel 40, a movable blade unit 50, and a fixed blade unit 60.

The base 10 comprises two standing plates 11 each having a fixing trough 12 and a guide trough 13 at an upper portion thereof.

The installation wheel 20 has a pair of pivots 21 protruding from two sides thereof. The installation wheel 20 is pivotally connected in the fixing troughs 12 of the two standing plates 11 of the base 10.

The press plate 30 is disposed between the two standing plates 11 and located close to the guide troughs 13 of the two standing plates 11. The press plate 30 has a stay portion 31 at one end thereof close to the guide troughs 13 of the two standing plates 11.

The rotary wheel 40 is pivotally connected between the two standing plates 11 and located close to the guide troughs 13 of the two standing plates 11. The rotary wheel 40 has a plurality of interlaced troughs 41 and slots 42 thereon.

The movable blade unit 50 is pivotally connected between the two standing plates 11, and comprises a movable seat 51, a moveable blade 52 and a spring 53. The movable seat 51 is pivoted close to the guide troughs 13 of the two standing plates 11. The movable seat 51 has a driving portion 511 at one end thereof. The driving portion 511 passes through the guide troughs 13 of the two standing plates 11. The movable seat 51 has a fixing portion 512 at another end thereof. The movable blade 52 is fixed on the fixing portion 512. One end of the movable blade 52 is connected to one end of the spring 53. Another end of the spring 53 is further connected to the base 10.

Figure 4:
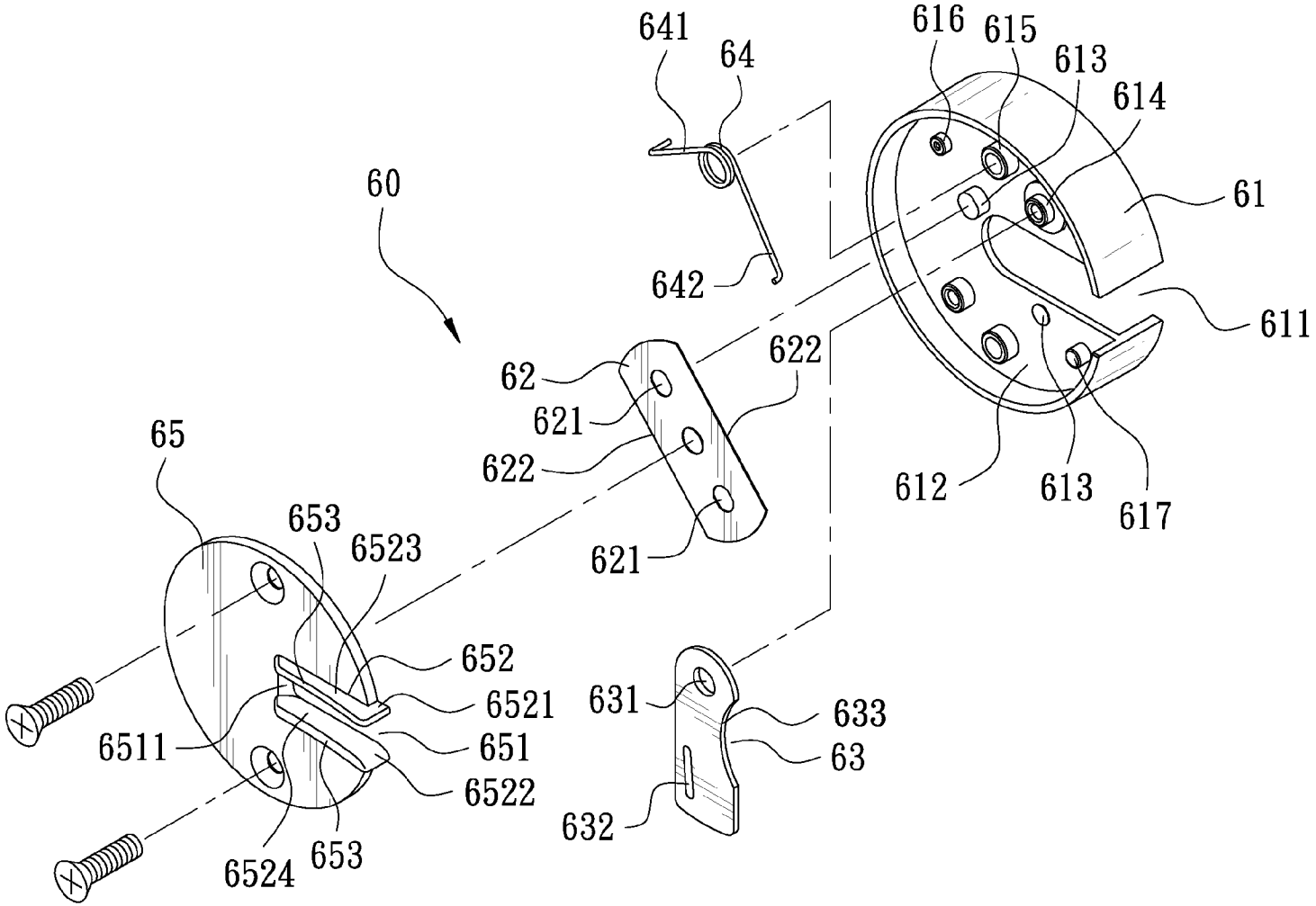
FIG. 4 is an exploded view of a fixed blade unit according to the preferred embodiment of the present invention.

Further referring to FIG. 2 with reference to FIG. 4, there show an exploded view of a fixed blade unit. The fixed blade units 60 is disposed on one side of the base 10 and located close to the guide troughs 13 of the two standing plates 11.

The fixed blade unit 60 comprises a seat 61, a fixed blade 62, a protective piece 63, an elastic member 64 and a lid 65.

The seat 61 has a cutting slot 611 corresponding to the guide troughs 13 of the two standing plates 11. The seat 61 has a chamber 612 facing the side of the base 10. The seat 61 further comprises two positioning posts 613, a connecting post 614, a fixing post 615 and a raised ring 616 which are disposed in the chamber 612.

The fixed blade 62 is disposed in the chamber 612 of the seat 61. The fixed blade 62 has positioning holes 621 corresponding to the positioning posts 613 of the seat 61 to be positioned on the positioning posts 613. The fixed blade 62 has an edge 622 across the cutting slot 611.

The protective piece 63 is made of a transparent material and substantially in form of a plate in the shape of a elongated one. The protective piece is disposed in the chamber 612 of the seat 61. One end of the protective piece 63 has a connecting hole 631 corresponding to the connecting post 614 of the seat 61 to be connected on the connecting post 614. Another end of the protective piece 63 has a limit slot 632 which is connected with the elastic member 64, such that the protective piece 63 is against one side of the fixed blade 62 opposite to the seat 61 to shield the edge 622 of the fixed blade 62 inwardly as a guiding side wall 633. The axis of the limit slot 632 is designed being not parallel to the axis of the protective piece 63. In this embodiment, the elastic member 64 is a torque spring fixed on the fixing post 615 of the seat 61. Two ends of the elastic member 64 are defined as a fixed end 641 and an elastic end 642. The fixed end 641 is fixed in the raised ring 616 protective piece 63 of the seat 61, and the elastic end 642 is confined in the limit slot 632 of the protective piece 63.

Figure 6:
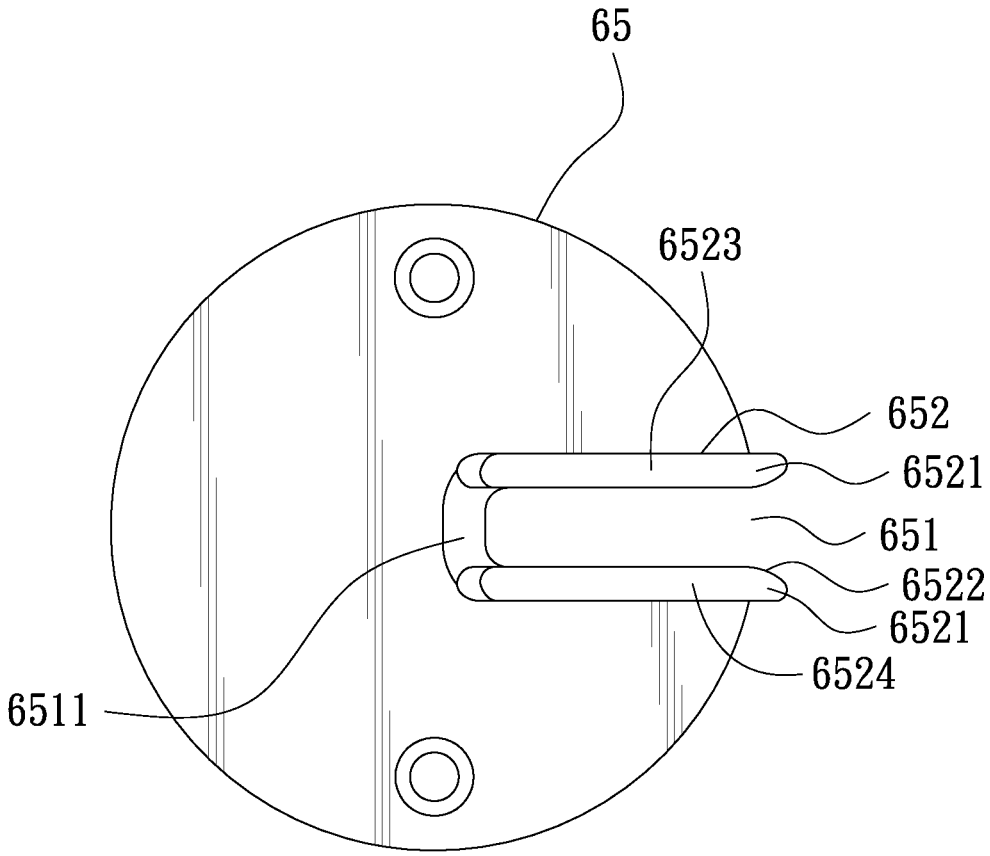
FIG. 6 is a front view of the lid of the fixed blade unit according to the preferred embodiment of the present invention.

Referring to FIG. 6 which shows a side view of a lid of the fixed blade unit, the lid 65 is to cover one side of the seat 61 opposite to the base 10. The lid 65 has a notch 651 corresponding to the cutting slot 611 of the seat 61 to form a pair of side walls 652. The width of the notch 651 is smaller than the same of the cutting slot 611. The lid 65 formed a guide slope 6511 at the close end of the notch 651. Said side walls 652 extend out of the lid 65 and each forms a protrusion 6521. The protrusion 6521 gradually diverges to form a slide face 6522. Referring to FIG. 4, the lid 65 further has a pair of flanges 653 protruding from the pair of side walls 652. The flanges 653, along with the side walls 652, gradually extends from the inner end to the open end of the notch 651

Figure 7:
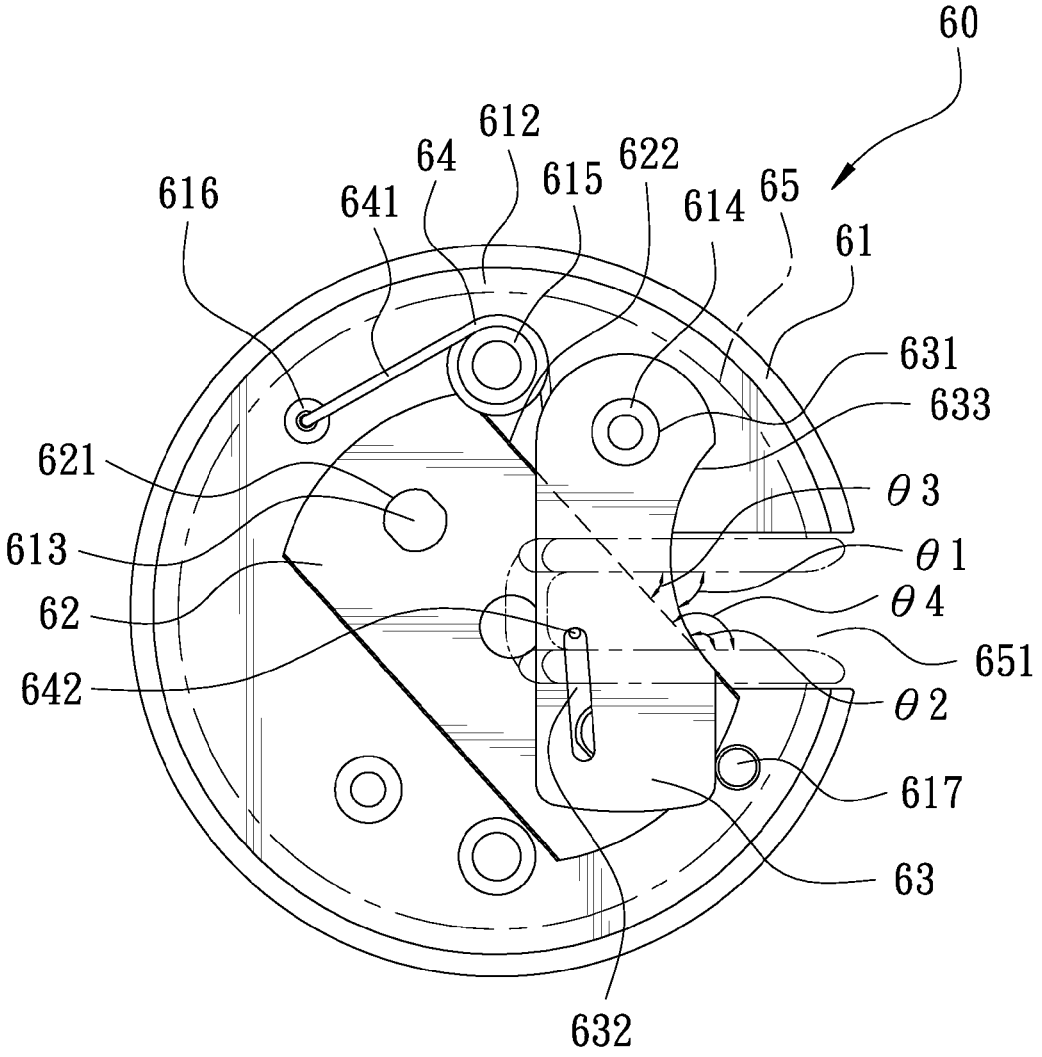
FIG. 7 is a schematic sectional view of the fixed blade unit according to the preferred embodiment of the present invention.

Referring to FIG. 7 which shows a schematic sectional view of the fixed blade unit according to the preferred embodiment of the present invention, the side wall 652 actually consists of a first side wall 6523 and a second side wall 6524. The first side wall 6523 is close to the connecting post 614 and the second side wall 6524 is far from the connecting post 614. When the lid 65 is covered onto the seat 61, the protective piece 63 will be across the notch 651 and thus forms a first angle θ1 and a second angle θ2. In ordinary situation, first angle θ1 is smaller than the second angle θ2. In the meantime, the edge 622 of the fixed blade 62 and the first wall 6523 forms a third angle θ3. The edge 622 of the fixed blade 62 and the second side wall 6524 forms a fourth angle θ4 which is greater than said third angle θ3.

Figure 8:
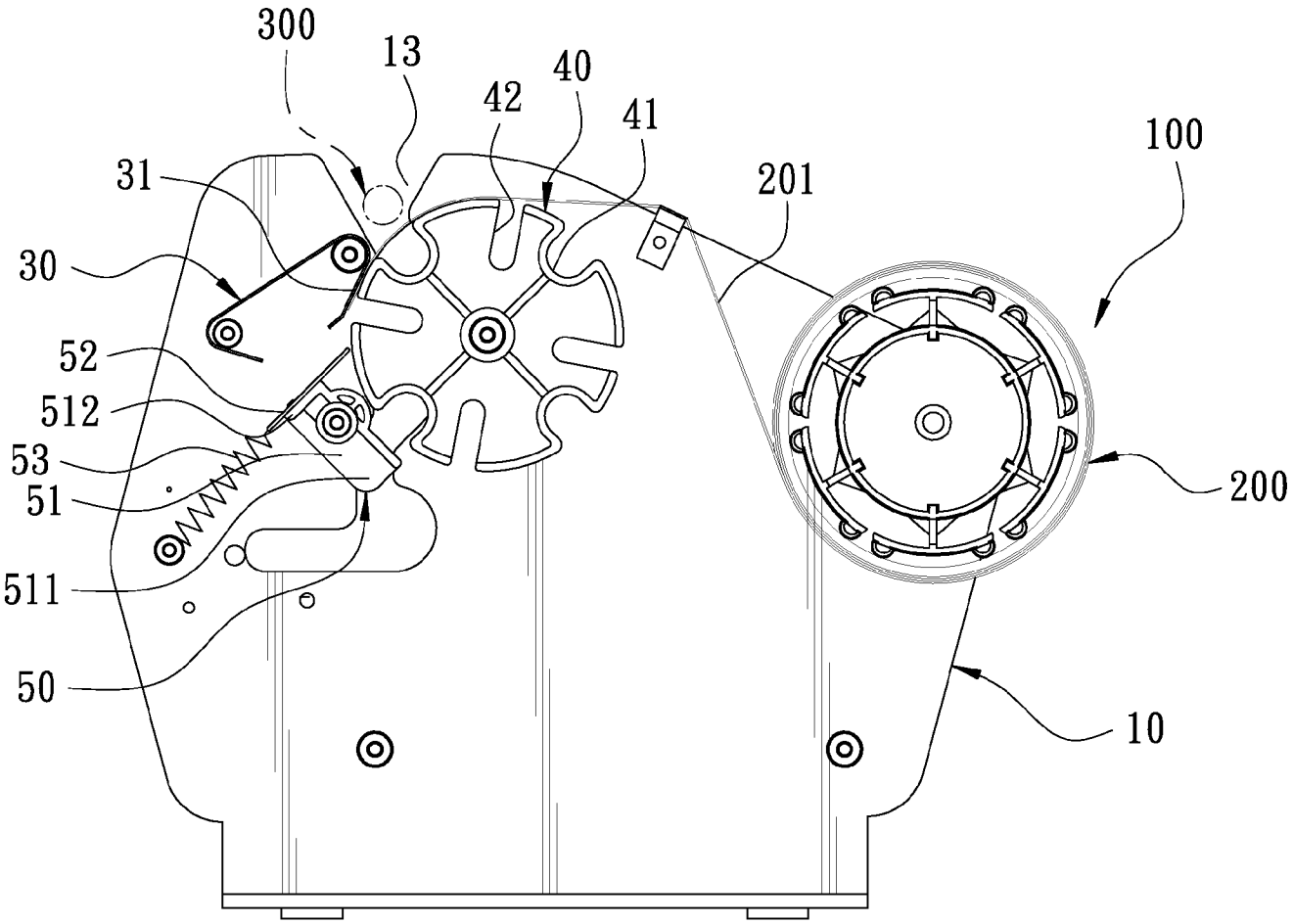
FIG. 8 is an illustrative view of the bag neck sealer to show the operation of the preferred embodiment of the present invention when in use.
Figure 9:
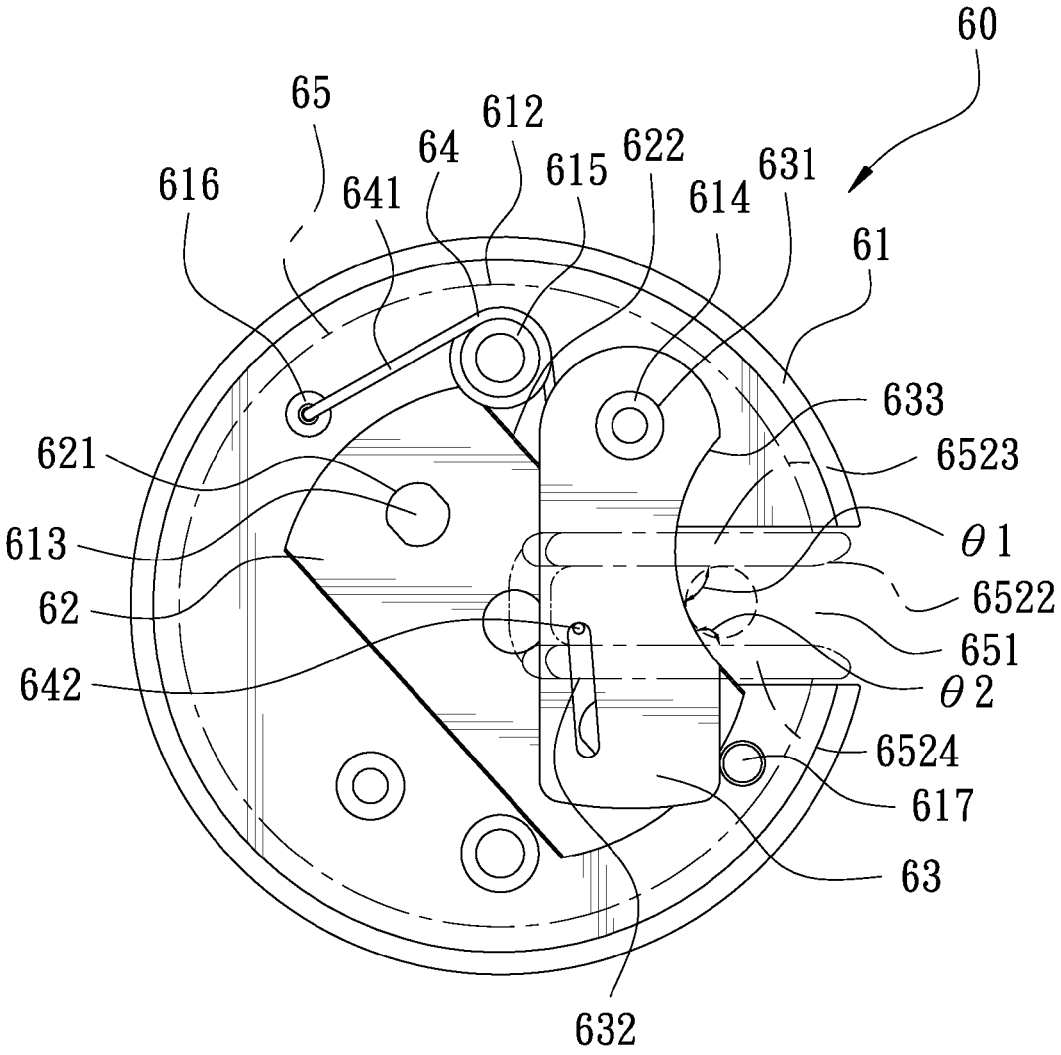
FIGS. 9 (*a*) to 9(*c*) are illustrative front views of the fixed blade unit showing the operation to cut the bag neck.
Figure 9:
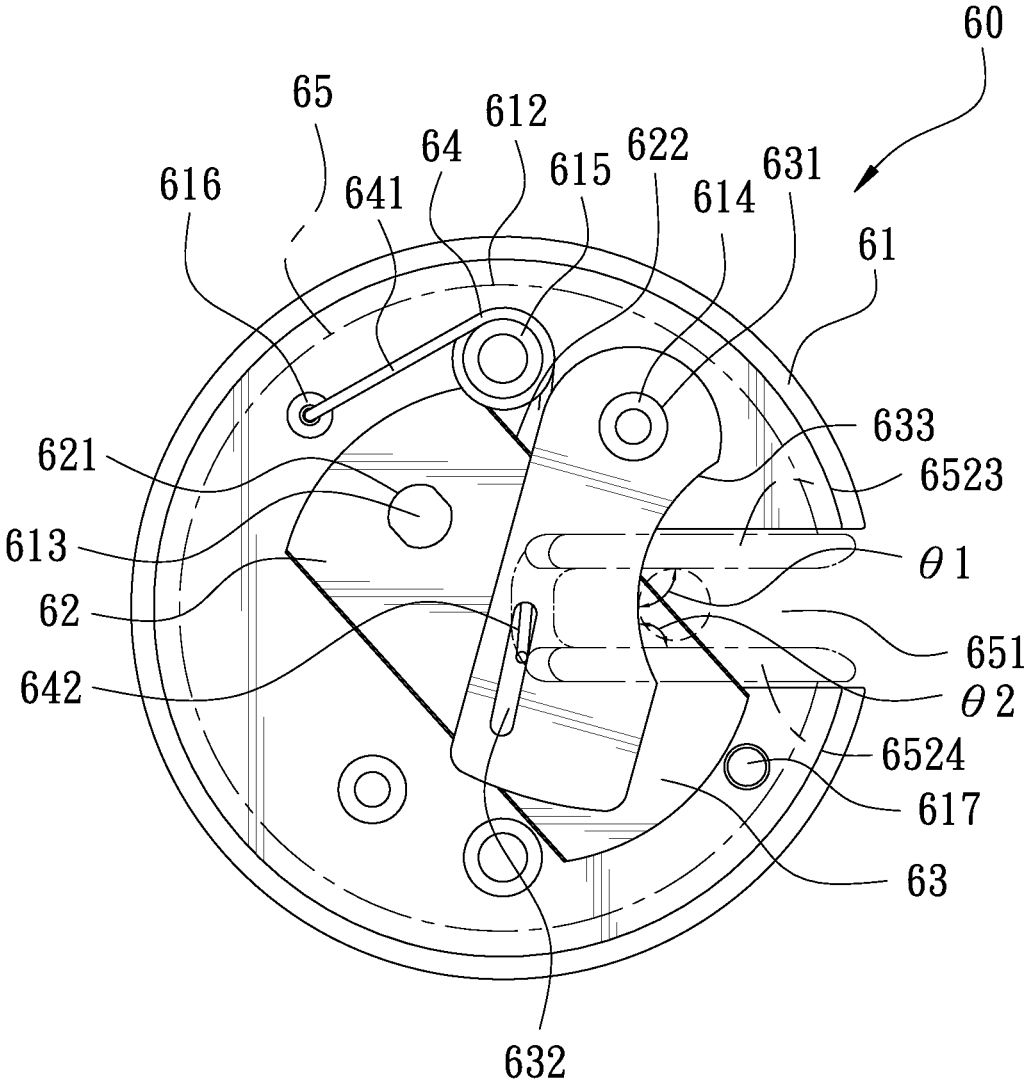
Figure 9:
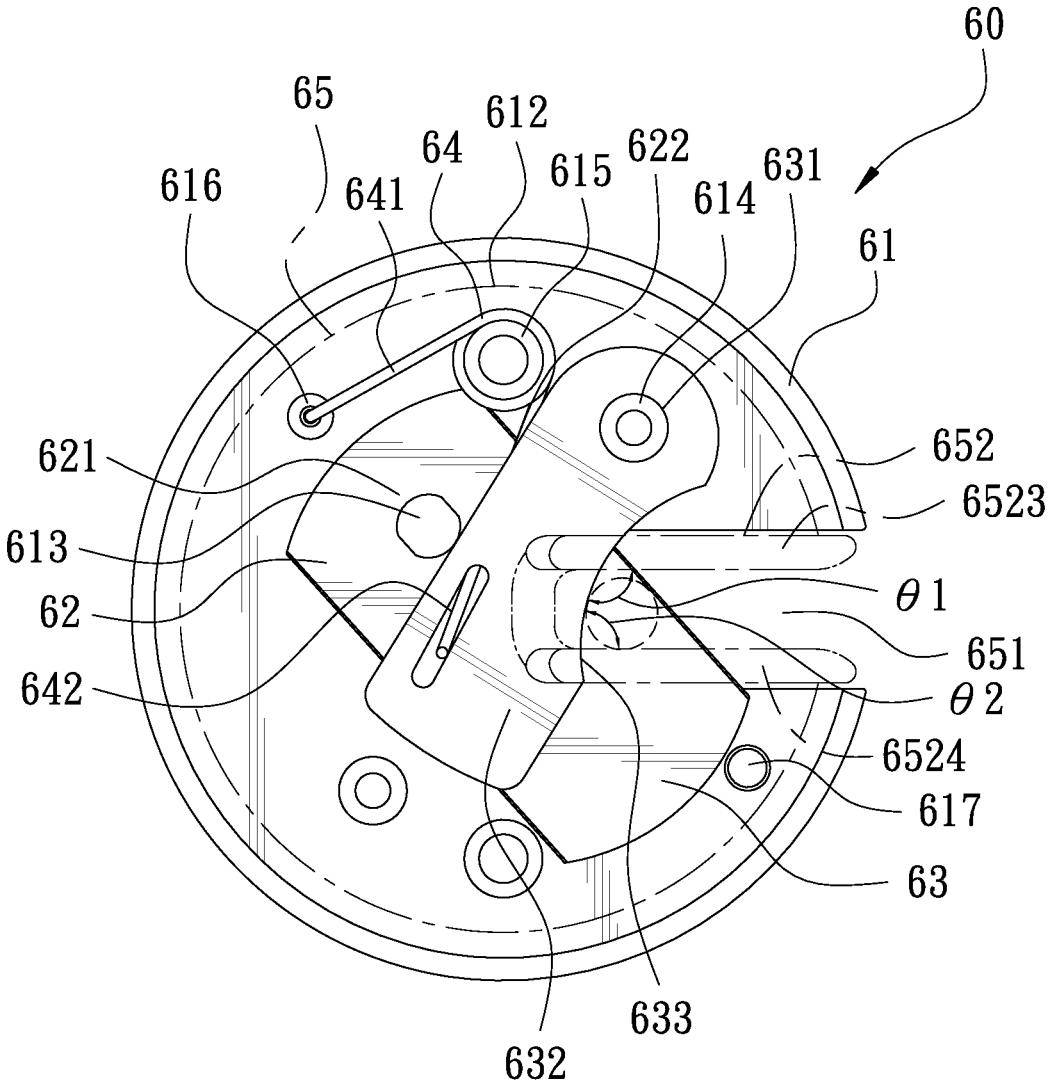

Referring to FIGS. 8 and 9 (*a*) to 9 (*c*) which show the illustrative view of the bag neck sealer in use and illustrative front views of the fixed blade unit showing the operation to cut the bag neck, when user starts to use the bag neck sealer 100, the user has to install a roll 200 of adhesive tape on the bag neck sealer 100. The installation wheel 20 is taken down from the base 10, and the roll of adhesive tape 200 is installed on the installation wheel 20. Then, the installation wheel 20 is placed in the fixing trough 12 of the two standing plates 11 again. The adhesive tape 201 is pulled out from the roll of the adhesive tape 200 and passes through the upper edge of the rotary wheel 40 to be adhered to the stay portion 31 of the press plate 30, such that the roll of adhesive tape 200 is completely assembled.

After that, the user can proceed to seal a bag 300. The open end of the bag 300 is slid into the trough 41 of the rotary wheel 40 through the guide troughs 13. Because the adhesive tape 201 passes through the upper edge of the rotary wheel 40, the adhesive tape 201 will be adhered on the bag 300 when the open end of the bag 300 is slid into the trough 41. When the bag 300 is continually moved downward, the adhesive tape 201 will be wound on the bag 300 along the rotation of the rotary wheel 40 to tighten the open end of the bag 300. When the bag 300 passes through the movable blade unit 50, the bag 300 will bring the driving portion 511 of the movable seat 51 to turn the movable seat 51, such that the movable blade 52 at the other end of the movable seat 51 is moved toward the rotary wheel 40 to extend into the slot 42 and to cut the adhesive tape 201. Finally, the user moves the bag 300 toward the fixed blade unit 60. As shown in FIG. 8, the bag 300 brings the protective piece 63 to turn, and then the fixed blade 62 is exposed to cut off the unnecessary portion of the bag 300 to complete the seal procedure.

It is to be noted as shown in FIG. 9(*a*), the bag 300 will move along the guide slop 6511 into the notch 651. Here it shows the bag 300 is confined by the guiding side wall 633 and the first side wall 6523. Then the bag 300 touches the protective piece 63 and cause it to rotate as shown in FIG. 9(*b*). The edge 622 of the fixed blade 62 will be gradually exposed along the direction of the second side wall 6524. The bag 300 will be cut by the edge 622. During this progress of protective piece 63 movement, the first angle θ1 will gradually become larger and the second angle θ2 will become gradually smaller. The bag 300 will along the guiding slope 6511 and being pushed against the edge 622 of the fixed blade 62. Referring to FIG. 9(*c*), when at the position that first angle θ1 becomes and reach a state larger than the second angle θ2, the bag will be cut completely. Now, the protective piece 63 shall be restored to its original and the bag 300 can be move away along the driving portion 511.

It is also to be noted that the axle of the limit slot 632 is designed being not parallel to the axle of the protective piece 63. The user may only need to exercise a very light force on the bag body 300 to push the protective piece 63.

Another feature according to the present invention is the fixed blade 62 can be removed when the edge 622 is no longer sharp enough for the bag body cutting. User may remove the lid 65 of the fixed blade unit 60 and have the fixed blade 62 to be changed very easily.

Figure 5:
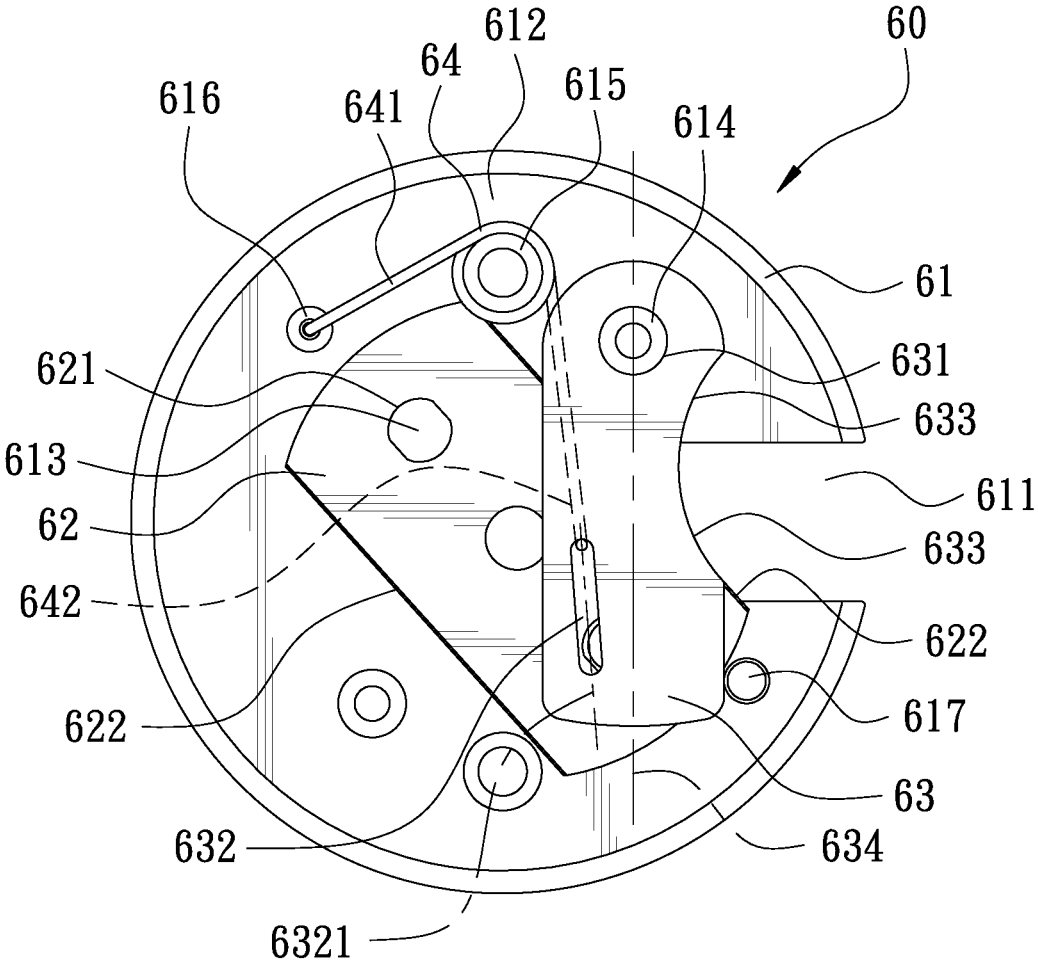
FIG. 5 is a cross-sectional view of the fixed blade unit with the lid of the same removed according to the preferred embodiment of the present invention.

Referring to FIGS. 4 and 5, the seat 61 has a limit port 617 provided at a position near the fix blade 62 and the slide face 6522. Therefore under normal situation, this limit port 617 will maintain the protective piece 63 kept in one side of the fixed blade 62. In another words, a position that first angle θ1 is smaller than the second angle θ2.

Another operation and feature is that the protective piece 63 of the fixed blade unit 60 is against one side of the fixed blade 62 opposite to the base 10 to completely shield the edge 622 of the fixed blade 62. Therefore, when the user operates the bag neck sealer 100, the user's fingers can be protected from the fixed blade 62 through the protective piece 63, preventing the fingers from being hurt so as to enhance the safety of the bag neck sealer 100. Besides, one side of the seat 61 is provided with the lid 65 opposite to the base 10, and the lid 65 has the flanges 653 protruding from the notch 651. When the user operates the bag neck sealer 100, the flanges 653 can protect the user's fingers from the fixed blade 62 to avoid any accident. Furthermore, the protective piece 63 is made of a transparent material, so the user can direct see the fixed blade 62 and check the replacement of the fixed blade 62 when operating the bag neck sealer 100.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A bag neck sealer comprising a base having a guide trough and an installation wheel thereon, a rotary wheel, a press plate and a movable blade unit disposed close to the guide trough, and a fixed blade unit disposed on one side of the base and located close to the guide trough characterized in:

said fixed blade unit having a seat and a lid;

said seat of the fixed blade unit having a cutting slot corresponding to the guide trough of said base, a fixed blade which has an edge protruding into said cutting slot, and a protective piece which being connected with an elastic member to be against one side of said fixed blade opposite to said edge of said fixed blade forming a guiding side wall thereof;

said lid having a pair of side walls forming a notch corresponding to said cutting slot of said fixed blade unit;

said lid has a first side wall forming a first angle with respect to said guiding side wall of said protective piece, said lid has a second side wall forming a second angle with respect to said guiding side wall of said protective piece, said first angle being smaller than said second angle;

said first side wall and said second side wall being in positions parallel to each other; and said first side wall forms a third angle with respect to said edge of said fixed blade, said second side wall forms a fourth angle with respect to said edge of said fixed blade, said third angle being smaller than said fourth angle.

2. The bag neck sealer as claimed in claim 1, wherein said seat of said fixed blade unit having a limiting port formed approximate to said edge of said fixed blade so as to maintain the position of said protective piece and keep said first angle being smaller than said second angle.

3. The bag neck sealer as claimed in claim 1, wherein the width of said notch being smaller than the same of said cutting slot.

4. The bag neck sealer as claimed in claim 1 wherein said lid having a guide slope at the close end of said notch of said protective piece.

5. The bag neck sealer as claimed in claim 1, wherein said side walls extend out of said lid and each forming a protrusion which gradually diverges to form a slide face.

6. The bag neck sealer as claimed in claim 1, wherein said protective piece having a limit slot formed thereon, the axis of the limit slot being designed to be not parallel to the axis of the protective piece.

7. The bag neck sealer as claimed in claim 1, wherein said protective piece is made of a transparent material, and is in the form of an elongated plate; said protective piece being disposed in a chamber formed in said seat of said fixed blade unit; one end of said protective piece having a connecting hole corresponding to a connecting post of said seat.

* * * * *